United States Patent [19]

Gibson

[11] Patent Number: 4,475,311

[45] Date of Patent: Oct. 9, 1984

[54] CUSTODIAL LATCH ASSEMBLY FOR WINDOWS AND THE LIKE

[75] Inventor: Richard L. Gibson, Blairsville, Pa.

[73] Assignee: Season-All Industries, Inc., Indiana, Pa.

[21] Appl. No.: 420,822

[22] Filed: Sep. 21, 1982

[51] Int. Cl.[3] ..... E05D 15/22; E05C 1/04

[52] U.S. Cl. ..... 49/176; 49/449; 292/153; 292/175

[58] Field of Search ..... 49/176, 161, 449, 450; 292/153, 175, 209

[56] References Cited

U.S. PATENT DOCUMENTS

| | | | |
|---|---|---|---|
| 8,286 | 8/1851 | Bush . | |
| 592,457 | 10/1897 | Toops . | |
| 637,755 | 11/1899 | Metz . | |
| 748,202 | 12/1903 | Mills . | |
| 767,001 | 8/1904 | Mann . | |
| 1,828,152 | 10/1931 | Nonamaker . | |
| 1,862,757 | 6/1932 | Menns | 49/176 X |
| 2,969,667 | 1/1961 | Newcomer, Jr. et al. | 292/140 X |
| 3,093,224 | 6/1963 | Wilson | 49/449 X |
| 3,129,470 | 4/1964 | Schneider | 292/174 |
| 3,425,728 | 2/1969 | Turner | 292/153 |
| 3,937,503 | 2/1976 | Harris | 292/153 |
| 4,195,867 | 4/1980 | Baillie | 292/174 |

*Primary Examiner*—Philip C. Kannan

*Attorney, Agent, or Firm*—Buell, Blenko, Ziesenheim & Beck

[57] ABSTRACT

A window construction having fixed and movable frames and an associated latch assembly. The latch assembly includes a latch housing, a latch member reciprocable within said housing and a cam lock. The cam lock is rotatably mounted within the housing and has a first position wherein the cam lock urges a latch member into a locked position and a second position wherein the latch member may be moved to an unlocked position. The cam lock is preferably composed of a resilient, resinous material and has a cantilevered portion which engages a portion of the latch member. A special tool or key of predetermined configuration may be required to rotate the cam member. Among other uses, the latch may be employed in connection with double hung windows which are adapted to be tilted inwardly for cleaning. In such use the windows may be subjected to sliding movement regardless of the latch position, but tilting movement may be accomplished only when the latch assembly is in a locked position.

27 Claims, 12 Drawing Figures

CUSTODIAL LATCH ASSEMBLY FOR WINDOWS AND THE LIKE

BACKGROUND OF THE INVENTION

1. Field of the Invention

This invention relates to a unique form of tamperproof latch and, more specifically, has advantageous use in respect of window constructions.

2. Description of the Prior Art

Numerous types of locking or latching devices for various uses including use on windows and doors have long been known.

U.S. Pat. No. 767,001 discloses a door holder wherein rotation of an operating lever causes a foot member to overcome spring bias and engage a floor to thereby maintain a door in a desired position.

U.S. Pat. No. 8,286 similarly discloses a door bolt wherein rotation of a lever urges the tongue portion of the bolt to project beyond the bolt housing.

U.S. Pat. No. 4,195,867 discloses several embodiments of a door latch wherein a rotatable member is adapted to engage a bolt member to move the same between locked and unlocked positions. In one embodiment a key must be employed before the latch can be operated.

U.S. Pat. No. 748,202 discloses a springless lock which is adapted to be operated by means of various counterweights and linkages. With respect to the locking bolt, a cam member is rotated to reciprocate the same.

U.S. Pat. No. 592,457 discloses a cam which is rotated by means of a pin in order to secure a window sash.

U.S. Pat. No. 637,755 discloses a window sash lock wherein a cam is said to position bolts which are spring biased. The positioning of the cam is effected by means of an externally projecting arm.

U.S. Pat. No. 1,828,152 discloses a pushbutton latch for cabinets wherein movement of the pushbutton is said to urge a cam into contact with a roller which is thereby urged against the force of a coil spring.

U.S. Pat. No. 3,129,470 discloses a multipiece window sash latch wherein a spring biased bolt may be manually engaged by means of projecting tab.

There remains a need for a highly efficient latch assembly which is economical to manufacture, tamperproof and is adapted to be surface mounted in either right or left hand positions while effectively, when used in a double hung window environment, permitting free sliding movement of the windows while resisting tilting movement.

SUMMARY OF THE INVENTION

The present invention has met the above-described needs and has provided a number of improvements over the prior art. In the present invention, the latch assembly includes a latch housing, a latch member reciprocable within the housing and a cam lock. The cam lock may preferably be composed of a resinous, resilient material and is rotatably mounted within the housing. In a first position the cam lock maintains the latched member in a locked position where the latch tongue projects out of the housing and into a suitable keeper. In a second cam lock position, the latch tongue may be moved to an unlocked position where the latch tongue is at least partially retracted into the housing.

The cam lock is provided with a generally circumferentially disposed cantilevered portion for contacting a rear portion of the latch member. Detent means may be provided on the exterior of the cantilevered portion so as to enhance engagement with the rear portion of the latch member. Also, relief may be provided in circumferential portions of the cam lock so as to facilitate retention in the desired position.

The cam lock may preferably have a semicircular configuration in plan. Also, to facilitate tamperproof characteristics, the cam lock is adapted to resist rotation except by use of a predetermined tool or key.

It is an object of the present invention to provide a latch assembly wherein desired, tamperproof characteristics are obtained.

It is a further object of this invention to provide such a latch assembly which is adapted for economical and efficient manufacture and use.

It is a further object of this invention to provide such a latch assembly which is adapted to be mounted on the surface of a window sash in either a left-hand or right-hand position.

It is yet another object of this invention to provide a latch assembly wherein a unique, rotatable cam member contributes significantly to both tamperproof and efficient operating characteristics of the assembly.

It is yet another object of the present invention to provide such a latch assembly which can be mounted on double hung windows which are adapted to be tilted to be cleaned and be so constructed as to not interfere with ordinary sliding movement of the windows when the latch assembly is in locked position.

These and other objects of this invention will be more fully understood from the following description of the invention on reference to the illustrations appended hereto.

DESCRIPTION OF THE PREFERRED EMBODIMENT

Figure 1:
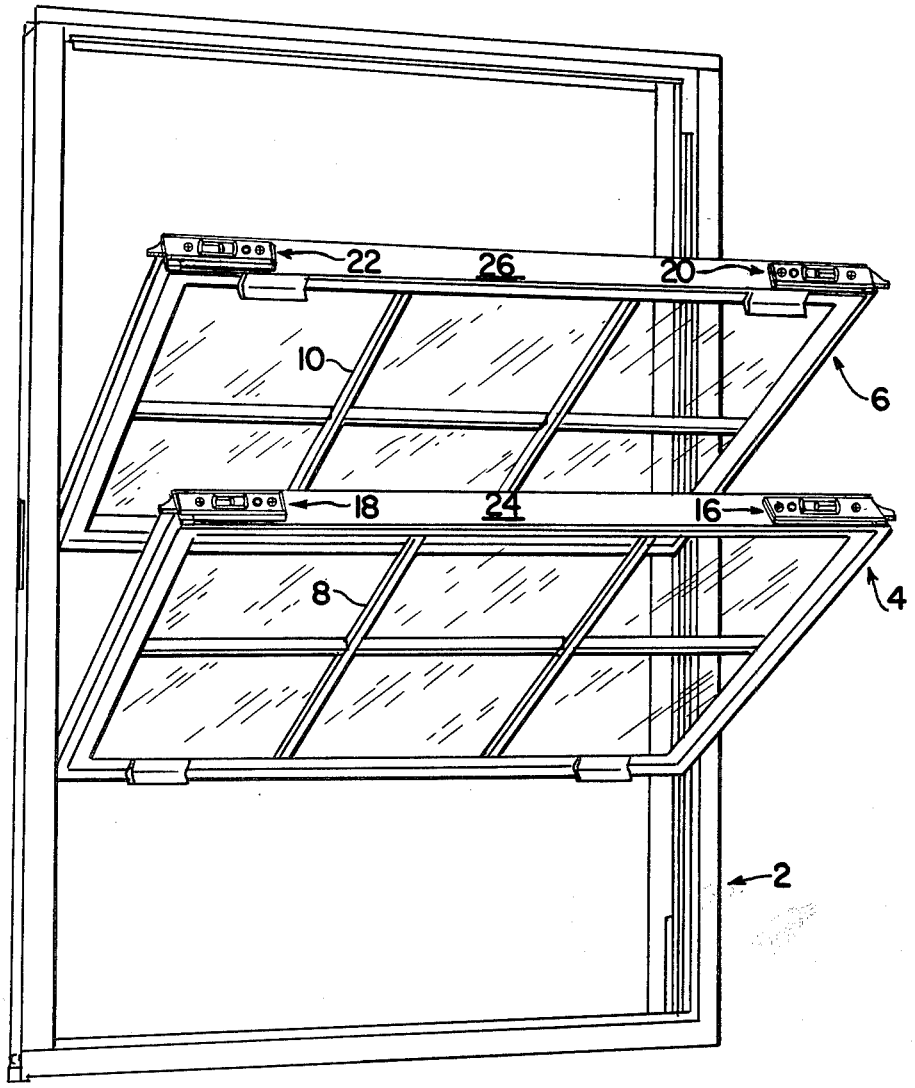
FIG. 1 is a perspective view of a form of window construction employing the latch assembly of the present invention.

Referring now more specifically to FIG. 1 there is shown a preferred end use environment of the present invention. The window construction shown in FIG. 1 shows a generally rectangular, fixed frame 2 which cooperates with a pair of sash frames 4, 6 which, in the form shown, respectively, have muntins 8, 10 disposed between panes of insulating glass. The illustrated window is a double hung window wherein each of the sash members 4, 6 is adapted to be generally vertically retained within the fixed frame 2 and is adapted to be moved, as desired by the user, in a generally vertical direction. As an added feature of these windows, but forming no part of the present invention per se, the windows are adapted to be tilted inwardly such as is shown in FIG. 1 in order to facilitate cleaning the exterior surfaces of the glass from the interior of the building. The latch assemblies of the present invention are adapted to permit locking of these sash frames 4, 6 so as to resist undesired tilting of the windows during regular use, but not interfere with the normal double hung vertical movement function of the sash frames 4, 6.

As is shown in FIG. 1, a pair of latch assemblies 16, 18 of the present invention are secured to the upper surface of top sash rail 24 of sash frame 4. Similarly, a pair of latch assemblies 20, 22 are secured to top sash rail 26 of sash frame 6. When these latch assemblies 16, 18, 20, 22 are in their locked positions, the latch tongue will project laterally outwardly and engage a portion of the fixed frame thereby resisting rotational movement of the sash frames 4, 6. In the preferred embodiment of the invention, through use of a suitable tool or a key, the cam lock of each latch assembly may be rotated thereby in a first cam lock position permitting subsequent manual retraction of the latch tongue within the latch housing and rotation of the sash frames 4, 6. A second cam lock position resists such manual retraction.

Figure 2:
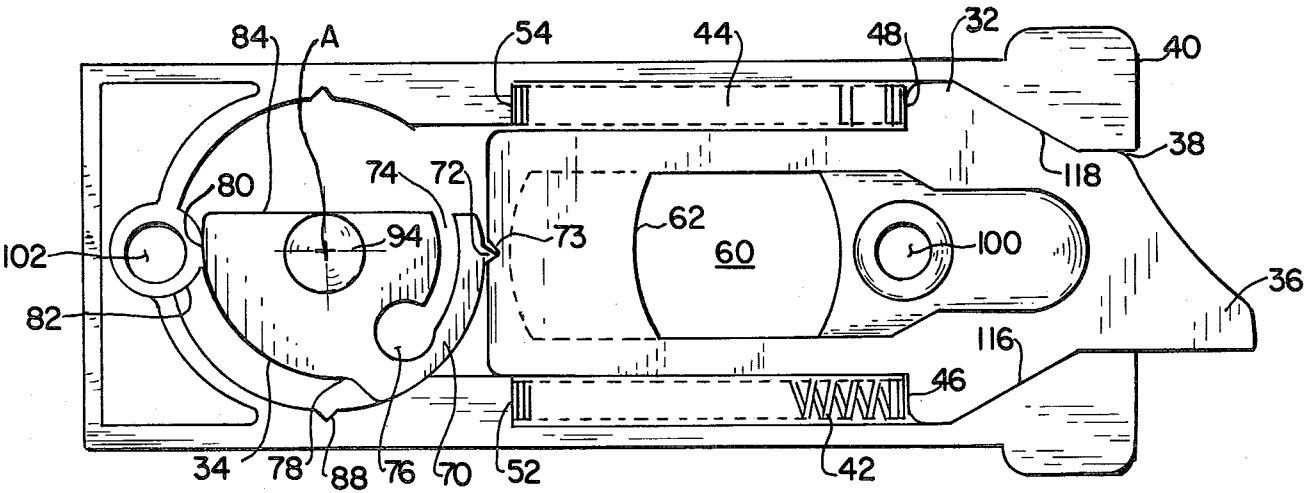
FIG. 2 is a bottom plan view of the latch assembly of the present invention.
Figure 3:
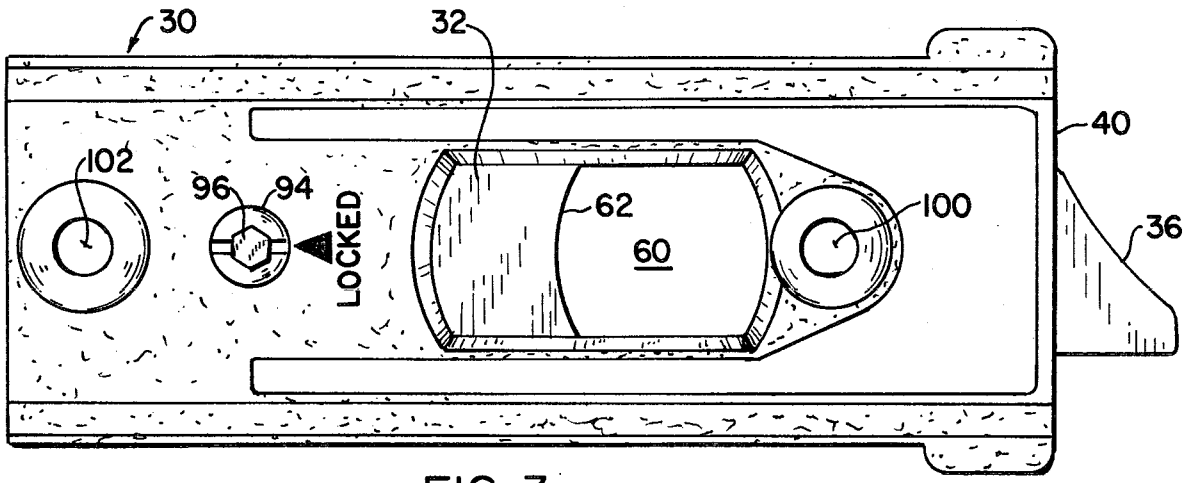
FIG. 3 is a top plan view of a form of latch assembly of the present invention generally similar to that of FIG. 2.
Figure 7:
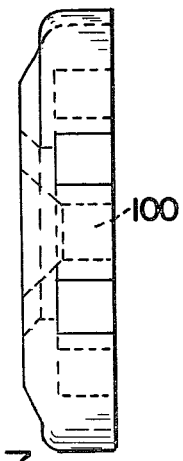
FIG. 7 is a right side elevational view of the housing member of FIGS. 4–6.
Figure 4:
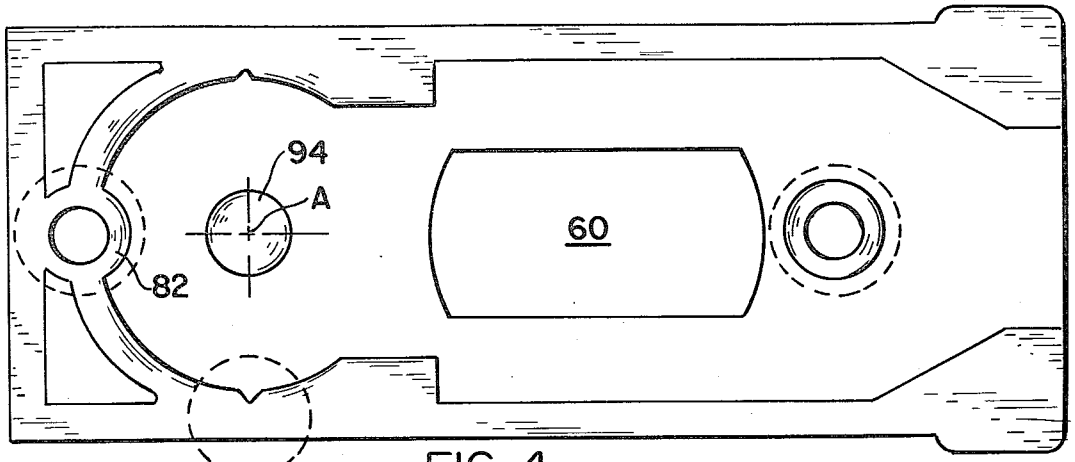
FIG. 4 is a bottom plan view of a form of housing member employed in the present invention.
Figure 5:
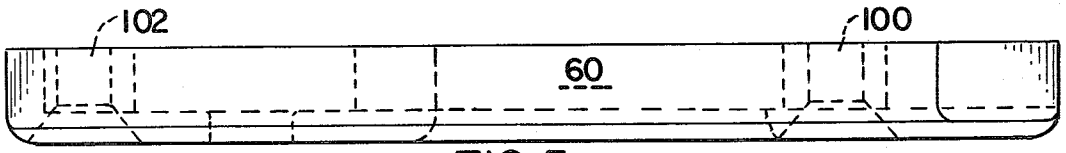
FIG. 5 is a front elevational view of the housing member of FIG. 4.
Figure 6:
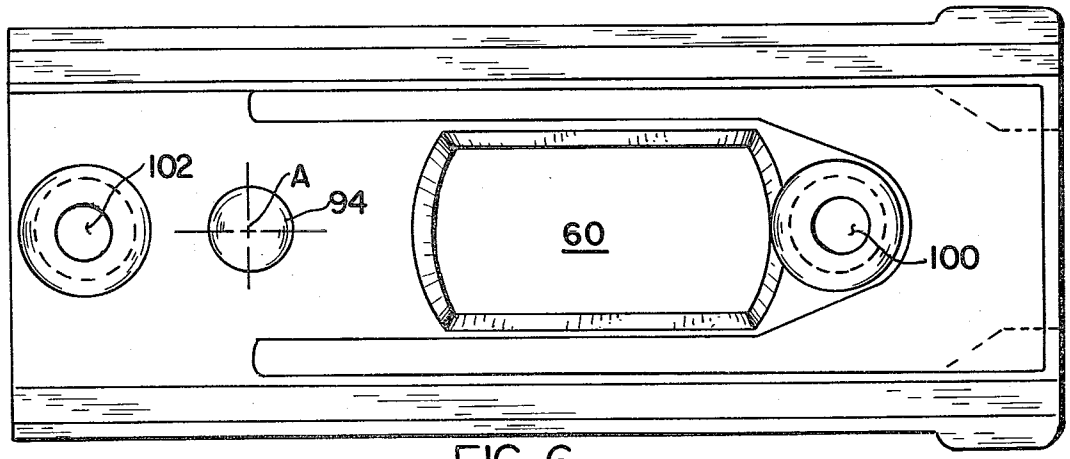
FIG. 6 is a top plan view of the housing member shown in FIG. 4.

Referring now to FIGS. 2 and 3, further details of the latch assembly of the present invention will now be considered. The housing 30 contains the latch member 32 which is adapted for generally longitudinal, reciprocable movement within the housing interior. The cam lock 34 is rotatable about axis A. In the form shown, the latch assembly is in locked position with the latch tongue 36 of the latch member 32 projecting through housing opening 38 a substantial distance beyond housing end wall 40. When the latch assembly is used as illustrated in FIG. 1, the tongue 36 will be engaged within a vertically oriented, generally inwardly open channel member so that the window may move in a vertical direction which would correspond to movement in and out of the page on FIGS. 2 and 3, but the channel sidewalls would resist rotational movement of the windows which would correspond with movement toward the upper or lower edges of the page as shown in FIG. 2 or 3. It will be appreciated, therefore, that retraction of the tongue 36 out of the channel-like restraint will be required to permit rotational movement of the window.

As is shown in FIG. 2, a pair of coil springs 42, 44 are contained within the housing and are engaged by shoulders 46, 48 respectively of the latch member 32. The opposite ends of the springs abut and may be permanently secured to shoulders 52, 54 of the housing 30. In this fashion, the springs 42, 44 will tend to urge the latch member 32 outwardly so that the tongue 36 is ih the projecting or locking position.

It will be noted that the housing has an opening 60 which permits manual engagement of a rear portion of the latch member 32. When the cam lock 34 is in an unlocked position, a user may place one or more fingers into opening 60, manually engage edge 62 of the latch member and move the same rearwardly (in the general direction of cam lock 34) in order to overcome the spring resistance and retract tongue 36 at least partially within the housing 30 and preferably completely within the housing This establishes an unlocked position which will permit rotational movement of the window sash frames.

Referring once again to FIG. 2, with particular reference to the cam lock member 34, it is noted that a generally circumferential curved cantilevered portion 70 projects outwardly from the main portion of the cam lock. An outwardly disposed, outwardly projecting detent 72 is formed on the cantilevered portion and is engaged by a recess 73 formed on the rear surface of the latching member. A groove 74 which terminates in a circular opening 76 permits the cantilevered member to effect spring action. This serves to enhance the intimacy of contact between the cam lock and the latching member. This feature also is a means for automatic tolerance control permitting economy and ease of manufacture and assembly of parts.

The circumference of the cam lock contains a pair of circumferentially spaced relieved portions 78, 80 which are adapted to be engaged by post member 82 so as to enhance the securement of the cam lock in the desired rotational position. The surface of the cam lock portion closest to axis A, about which the cam lock rotates, is surface 84 which is substantially flat, thus creating a generally semicircular configuration for the cam lock when viewed in plan. This surface 84 provides the desired operating clearance for bolt 32 when the cam lock 34 is in an unlocked position.

Portions of the housing surrounding the cam lock also contain recesses 86, 88 which are of generally complementary configuration with respect to detent 72. It will be appreciated that when the cam lock is rotated, in a fashion to be described hereinafter, such as rotation 90 degrees in a clockwise direction from the position shown in FIG. 2, detent 72 will enter recess 88 and post 82 will engage relief portion 78, thus securing the cam lock in that rotational position.

Considering further FIG. 2, it will be noted that in the illustrated position, the latched member is locked. If one were to apply a manual force on edge 62 of the latching member, the cantilever spring action would permit the cantilever portion 70 to move rearwardly approximately the width of groove 74 before firm engagement of the two portions of the cam lock 34 would be effected. At that point, farther rearward motion of the latch member 32 could not be effected. Thus the cam lock in this position would retain the tongue 36 in latched position. Were the cam lock moved to an unlocking position as by a clockwise rotation of 90 degrees, flat surface 84 of the cam lock would be disposed in spaced relationship with respect to the rear of the latch member 32 through manual engagement and overcoming of the force of springs 42, 44, the latch member 32 might then be moved rearwardly so as to retract the tongue member.

Referring now to FIG. 3 in greater detail, the childproof and tamperproof nature of the invention will be considered. A cap member 94 is projecting downwardly into the housing and is rigidly secured to cam lock 34 for unitary rotation therewith. Cap member 94 is preferably formed integrally with cam lock 34. The cap member 94 has, in the form shown, an hexagonal recess 96. In order to effect rotation of the cam member a suitable wrench such as an Allen wrench, must be inserted into recess 96 and sufficient torque applied to overcome the engagement between detent 72 and an associated recess 73, 88 as well as between relief 78 and post 82. It will be appreciated that other tool shapes including key locks may be employed in order to resist efforts to rotate cam lock 34 by means of use of the hands without a suitable tool or key.

Referring still to FIGS. 2 and 3, it will be noted that openings 100, 102 pass completely through the housing and assembly These openings may be used to secure the latch assembly in the desired end use environment as by screwing or other suitable fastener means.

One advantageous means of fabricating the components used in the latch assembly of the present invention is through the use of moldable, resinous materials. Among the preferred materials out of which the components may be made are plastic and rubber materials, such as polycarbonate, nylon, acetals and polyesters.

FIGS. 4 through 7 are detailed illustrations of a preferred form of housing of the present invention. It will be appreciated that the peripheral walls and internal dividing walls serve to provide effective containment for the cam lock 34 and latch member (not shown in these views).

Figure 10:
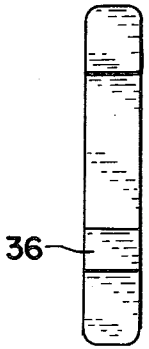
FIG. 10 is a right side elevational view of the latch member of FIG. 8.
Figure 8:
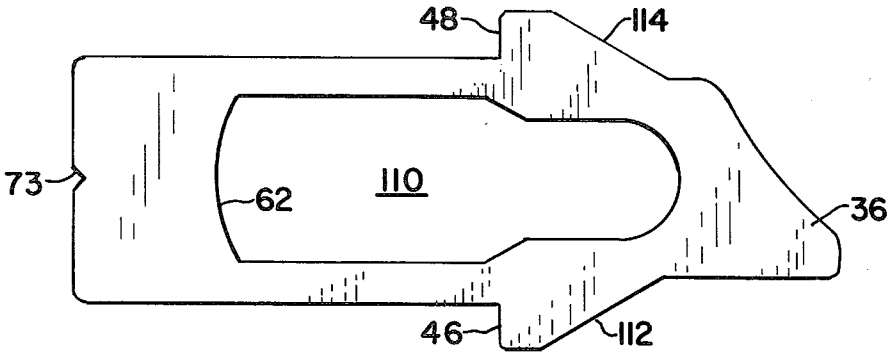
FIG. 8 is a top plan view of a latch member of the present invention.
Figure 9:
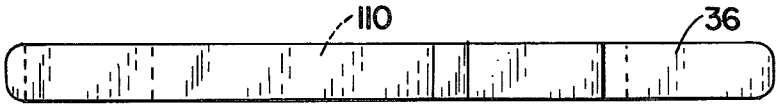
FIG. 9 is a front elevational view of the latch member of FIG. 8.

FIGS. 8 through 10 show detailed views of the latching member of the present invention. The central opening 110 in the latching member facilitates manual engagement of edge 62 through cooperation between opening 60 in the housing and this opening. It will be appreciated that angular surfaces 112, 114, respectively, engage angularly disposed surfaces 116, 118, (FIG. 2) of the housing so as to limit forward movement of the latching member 32.

Figure 12:
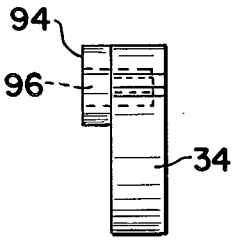
FIG. 12 is a right side elevational view of the cam lock of FIG. 11.
Figure 11:
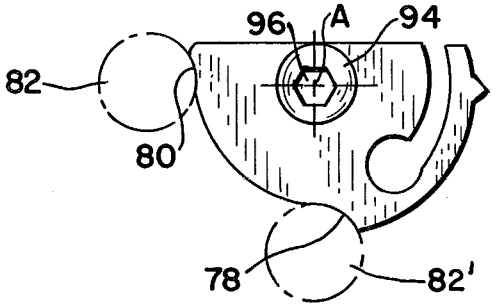
FIG. 11 is a top plan view of a form of cam lock of the present invention.

Referring now to FIGS. 11 and 12, further details of the cam lock are shown. As will be seen in FIG. 11, cap member 94 is either integrally formed with or fixedly secured to cam lock 34 so that the two may rotate as a unit.

In FIG. 11, relief portions 78, 80 are so configurated as to have generally complementary surface-to-surface relationship with respect to post members 82 and 82' shown in phantom in this Figure.

It will be appreciated, therefore, that the present invention provides an efficient and economical means for creating and employing a tamperproof latch assembly which is adapted to be surface mounted in right or left hand position. In addition, a uniquely configurated cam member which includes an integrally formed cantilever curved spring member cooperates with adjacent portions of the housing and latch member so as to either maintain the latch member in projected locking position or to permit release of the latch by manual engagement of the same. All of this is accomplished in a manner which does not require complex manufacturing techniques or impose any difficulties in educating authorized users as to the simple mode of operation.

While it will be appreciated that the latch assembly may advantageously be employed in respect of the preferred use in window installations, the invention is not so limited and the assembly as well as the unique components may be advantageously employed in other environments.

Whereas particular embodiments of the invention have been described above for purposes of illustration, it will be evident to those skilled in the art that numerous variations of the details may be made without departing from the invention as defined in the appended claims.

I claim:

1. A window construction comprising a fixed frame, a sash frame movable within said fixed frame, a latch assembly secured to said sash frame, said latch assembly including a latch housing, a latch member reciprocable within said housing and a cam lock, said cam lock being rotatably mounted within said housing and having a first position wherein said cam lock urges said latch member to a locked position where the latch tongue projects out of said housing and a second position wherein said latch tongue may be moved to an unlocked position where said latch tongue is at least partially retracted into said housing, and said cam lock having a cantilevered portion for contacting a rear portion of said latch member when in said first position.

2. The window construction of claim 1 including said window being a double-hung window with each said sash frame being slidably movable with respect to said fixed frame even when said latch assembly is in locked position.

3. The window construction of claim 2 including said sash frames being rotatable with respect to said fixed frame, and said sash frames being rotatable with respect to said fixed frames solely when said cam lock is in said second position.

4. The window construction of claim 3 including at least one said latch assembly being secured to the top rail of each said sash frame.

5. The window construction of claim 4 including said cam lock composed of a resilient material.

6. The window construction of claim 5 including said cam lock having a generally semicircular configuration in plan.

7. The window construction of claim 6 including said cam lock cantilevered portion disposed generally circumferentially about at least a portion of the periphery of said cam lock.

8. The window construction of claim 7 including at least one relieved portion in the circumference of said cam lock to facilitate retention of said cam lock in a desired position.

9. The window construction of claim 8 including said latch housing having post means for engaging said relieved portions of said cam lock to resist undesired rotation thereof.

10. The window construction of claim 7 including detent means projecting from the exterior of said cam lock for engaging said latch member.

11. The window construction of claim 9 including recess means in the rear of said latch member for engagement by said detent means.

12. The window construction of claim 4 including spring means for urging said latch member into a locked position.

13. The window construction of claim 12 including opening means in said latch housing for permitting manual movement of said latch member to an unlocked position when said cam lock is in said second position.

14. The window construction of claim 13 including lock means for resisting manual rotation of said cam lock without use of a predetermined tool or key.

15. The window construction of claim 14 wherein said lock means includes a generally hexagonal socket for receipt of a wrench.

16. A latch assembly comprising a latch housing a latch member reciprocable within said housing, a cam lock, said cam lock being rotatably mounted within said housing and having a first position wherein said cam lock urges said latch member to a locked position where the latch tongue projects out of said housing and a second position wherein said latch tongue may be moved to an unlocked position where said latch tongue is at least partially retracted into said housing, and said cam lock having a cantilevered portion for contacting a rear portion of said latch member when in said first position.

17. The latch assembly of claim 16 wherein said cam lock is composed of a resilient material.

18. The latch assembly of claim 17 including said cam lock having a generally semicircular configuration in plan.

19. The latch assembly of claim 18 including said cam lock cantilevered portion disposed generally circumferentially about at least a portion of said cam lock.

20. The latch assembly of claim 19 including at least one relieved portion in the circumference of said cam lock to facilitate retention of said cam lock in a desired position.

21. The latch assembly of claim 20 including said latch housing having post means for engaging said relieved portions of said cam lock to resist undesired rotation thereof.

22. The latch assembly of claim 20 including detent means projecting from the exterior of said cam lock cantilevered portion for engaging said latch member.

23. The latch assembly of claim 22 including recess means in the rear of said latch member for engagement by said detent means.

24. The latch assembly of claim 23 including spring means for urging said latch member into a locked position.

25. The latch assembly of claim 24 including opening means in said latch housing for permitting manual movement of said latch member to an unlocked position when said cam lock is in said second position.

26. The latch assembly of claim 25 including lock means for resisting manual rotation of said cam lock without use of a predetermined tool or key.

27. The latch assembly of claim 26 including said lock means having a generally hexagonal socket for receipt of a wrench.

* * * * *